United States Patent [19]

Huhn et al.

[11] Patent Number: 4,555,419

[45] Date of Patent: Nov. 26, 1985

[54] METHOD OF IMPREGNATING TEXTILE MATERIALS MADE FROM ORGANIC FIBERS

[75] Inventors: Karl Huhn, Burghausen, Fed. Rep. of Germany; Günter von Au, Sao Paulo, Brazil

[73] Assignee: Wacker-Chemie GmbH, Munich, Fed. Rep. of Germany

[21] Appl. No.: 627,125

[22] Filed: Jul. 2, 1984

[30] Foreign Application Priority Data

Sep. 13, 1983 [DE] Fed. Rep. of Germany ..... 3332997

[51] Int. Cl.[4] ..... B05D 3/02

[52] U.S. Cl. ..... 427/387; 427/54.1; 427/389; 427/392; 427/393.4; 427/389.9

[58] Field of Search ..... 427/387, 393.4, 389.9, 427/54.1, 392, 389

[56] References Cited

U.S. PATENT DOCUMENTS 3,697,473 10/1972 Polmanteer et al. .... 260/448.2 D X
4,013,611 3/1977 Hechtl et al. ..... 260/37 SB
4,098,701 7/1978 Burrill et al. ..... 252/8.6
4,154,714 5/1979 Hockemeyer et al. ..... 428/447 X
4,370,365 1/1983 Takamizawa et al. ..... 427/387
4,433,007 2/1984 Marwitz et al. ..... 427/54.1
4,436,856 3/1984 Huhn et al. ..... 524/211

*Primary Examiner*—Thurman K. Page

[57] ABSTRACT

A method for impregnating textile materials made from organic fibers which comprises impregnating the textile materials with a composition containing a crosslinkable diorganopolysiloxane, an organopolysiloxane containing at least 3 Si-bonded hydrogen atoms per molecule, a crosslinking catalyst, and an organo(poly)siloxane containing 1 or 2 Si-bonded hydrogen atoms and 2 to 8 silicon atoms per molecule, in which the composition is free of a filler having a surface area greater than 50 $g/m^2$ in an amount greater than 1 weight percent based on the weight of the organosilicon compounds and thereafter crosslinking the crosslinkable diorganopolysiloxane to form a coating thereon.

9 Claims, No Drawings

METHOD OF IMPREGNATING TEXTILE MATERIALS MADE FROM ORGANIC FIBERS

The present invention relates to textile materials and more particularly to a method for impregnating textile materials made from organic fibers to impart a soft hand thereto.

BACKGROUND OF THE INVENTION

Textile materials prepared from organic fibers have been impregnated in accordance with the method described, for example, in U.S. Pat. No. 4,098,701 to Burrill, in which a composition containing a diorganopolysiloxane having terminal Si-bonded hydroxyl groups, an organopolysiloxane containing at least 3 Si-bonded hydrogen atoms per molecule and a crosslinking catalyst is applied to textile materials and thereafter the diorganopolysiloxane is crosslinked by the condensation of the Si-bonded hydrogen and Si-bonded hydroxyl groups. U.S. Pat. No. 4,154,714 to Hockemeyer et al describes a method for impregnating textile materials in which a composition containing a diorganopolysiloxane having SiC-bonded aliphatic multiple bonds, an organopolysiloxane having at least 3 Si-bonded hydrogen atoms per molecule and a catalyst is applied to the textile materials and then crosslinked by the addition of the Si-bonded hydrogen atoms to the SiC-bonded aliphatic multiple bonds. The impregnated textile materials containing the organosilicon compounds often exhibit a harsh hand.

It is therefore an object of this invention to provide impregnated textile materials which have a pleasant, soft hand. Another object of the present invention is to provide impregnated textile materials made of organic fibers which are water repellent. Still another object of the present invention is to water-proof impregnated textile materials. A further object of the present invention is to provide impregnated textile materials made of organic fibers which are stable to cleaning with water and/or organic solvents.

SUMMARY OF THE INVENTION

The above objects and others which will become apparent from the following description are accomplished in accordance with this invention, generally speaking, by (A) impregnating textile materials made of organic fibers with a composition comprising (1) a crosslinkable diorganopolysiloxane, (2) an organopolysiloxane having at least 3 Si-bonded hydrogen atoms, (3) an organo(poly)siloxane having 1 or 2 Si-bonded hydrogen atoms and containing 2 to 8 silicon atoms per molecule, and (4) a crosslinking catalyst, in which the composition is free of a filler having a surface area greater than 50 $m^2/g$ in an amount greater than 1 percent by weight based on the weight of the organosilicon compounds, and (B) thereafter crosslinking the crosslinkable diorganopolysiloxane.

DESCRIPTION OF THE INVENTION

Compositions containing a diorganopolysiloxane, an organopolysiloxane having at least 3 Si-bonded hydrogen atoms per molecule and an organo(poly)siloxane containing only 2 Si-bonded hydrogen atoms per molecule, which are crosslinked by the addition of Si-bonded hydrogen to SiC-bonded organic radicals containing aliphatic mutliple bonds, have been described in U.S. Pat. Nos. 3,697,473 to Polmanteer et al and 4,057,596 to Takamizawa et al. However, these patents do not disclose impregnating textile materials with these compositions.

U.S. Pat. No. 4,013,611 to Hechtl et al also describes compositions containing a diorganopolysiloxane, an organopolysiloxane having at least 3 Si-bonded hydrogen atoms per molecule and an organo(poly)siloxane having only 2 Si-bonded hydrogen atoms per molecule, in which the diorganopolysiloxane is crosslinked with the organopolysiloxane having at least 3 Sibonded hydrogen atoms per molecule by the addition of Si-bonded hydrogen to SiC-bonded organic radicals having aliphatic multiple bonds. However, this patent discloses that a filler having a surface area of at least 50 $m^2/g$ is an essential ingredient of the composition. Moreover, this patent does not disclose the concept of coating fabrics nor does it disclose or suggest that a pleasant, soft hand is retained or imparted by treatment with the compositions described therein.

Even though "Textilbericht" Abstract of Japanese Patent No. 57-171,769[82-171,769](issued Oct. 22, 1982, Shinetsu Chemical Industry Co., Ltd.), discloses that a soft hand is imparted to textiles by a textile finish which contains an organopolysiloxane having at least 3 Si-bonded hydrogen atoms per molecule, a crosslinking catalyst and an organo(poly)siloxane having 2 Si-bonded hydrogen atoms and more than 8 silicon atoms per molecule and a viscosity of at least 10 mPa.s at 25° C., in addition to a diorganopolysiloxane which has one Si-bonded hydroxyl group in each terminal unit, the textile materials which are treated in accordance with the method of this invention, surprisingly, have a softer hand than those obtained by the method described in this publication.

In the present invention, it is preferred that the crosslinkable diorganopolysiloxanes have one Si-bonded hydroxyl group in each terminal unit when the compositions are to be crosslinked by the condensation of Si-bonded hydroxyl groups. It is possible to use in the method of this invention the same diorganopolysiloxanes having one Si-bonded hydroxyl group in each terminal unit which have been used or could have been used heretofore for impregnating organic fibers which also employ a diorganopolysiloxane having one Si-bonded hydroxyl group in each terminal unit. The preferred diorganopolysiloxanes having one Si-bonded hydroxyl group in each terminal unit are represented by the formula $$HO(SiR_2O)_nH,$$

wherein R represents the same or different monovalent hydrocarbon radicals or halogenated monovalent hydrocarbon radicals and n is an integer having a value such that the average viscosity of these diorganopolysiloxanes is 100 to more than $10^6$ mPa.s at 25° C.

Other siloxane units can also be present within or along the organopolysiloxane chain having the above formula. In addition to the diorganopolysiloxane units ($R_2SiO$), the other siloxane units are not generally represented in such formulas. Examples of such other siloxane units which, however, are generally present only as impurities, have the formulas $RSiO_{3/2}$, $R_3SiO_{1/2}$ and $SiO_{4/2}$, wherein R is the same as above. The quantity of these other siloxane units other than the diorganosiloxane units, is preferably at most 10 percent and more preferably at most 5 percent of the number of siloxane units in the cross-linkable diorganopolysiloxane.

The radicals represented by R, i.e., the SiC-bonded organic radicals in the crosslinkable diorganopolysiloxane used in the method of this invention contain from 1 to 20 carbon atoms per radical. Examples of hydrocarbon radicals represented by R in the crosslinkable diorganopolysiloxane used in the method of this invention are alkyl radicals such as the methyl, ethyl, n-propyl and isopropyl radicals as well as butyl, octyl, tetradecyl and octadecyl radicals; alkenyl radicals such as the vinyl and allyl radicals; cycloaliphatic hydrocarbon radicals such as the cyclohexyl and cycloheptyl radicals and cyclohexenyl radicals; aryl radicals such as the phenyl radical and naphthyl radicals; alkaryl radicals such as the tolyl radicals and aralkyl radicals such as the benzyl radical. Examples of halogenated hydrocarbon radicals, i.e., the SiC-bonded organic radicals in the crosslinkable diorganopolysiloxane used in the method of this invention are the 3,3,3-trifluoropropyl radical and o-, p- and m-chlorophenyl radicals. The SiC-bonded organic radicals in the crosslinkable diorganopolysiloxane used in this invention also may contain ether oxygen atoms in addition to hydrogen, carbon and fluorine atoms, e.g., the tetrafluoroethyloxypropyl radical. In particular, due to their availability, it is preferred that at least 80 percent of the number of R radicals, and thus the SiC-bonded organic radicals in the diorganopolysiloxane used in the method of this invention are methyl radicals. The crosslinkable diorganopolysiloxane may contain only a single molecular species or it may contain a mixture of different molecular species.

When crosslinking occurs by the addition of Si-bonded hydrogen to SiC-bonded organic radicals containing aliphatic multiple bonds, any diorganopolysiloxane having SiC-bonded organic radicals that have aliphatic multiple bonds which has been or could have been used heretofore for impregnating organic fibers, in which the diorganopolysiloxane having SiC-bonded organic radicals containing aliphatic multiple bonds is cross-linked by the addition of Si-bonded hydrogen to SiC-bonded organic radicals having aliphatic multiple bonds, may be employed in this invention. Preferred diorganopolysiloxanes containing SiC-bonded organic radicals having aliphatic multiple bonds may be represented by the following formula $$CH_2{=}CH(SiR_2'O)_nSiR_2'CH{=}CH_2,$$

in which R' is the same as R above, except that at least 99 percent of the number of R' radicals are free of aliphatic multiple bonds and n is the same as above.

Other siloxane units may be present within or along the diorganopolysiloxane chain in addition to the diorganosiloxane units. The same siloxane units which may be present as impurities in the crosslinkable diorganopolysiloxanes that are crosslinked by the condensation reaction may also be present in crosslinkable diorganopolysiloxanes which are crosslinked by the addition reaction and which are represented by the above formula.

The diorganopolysiloxanes which are crosslinked by addition may contain only a single molecular species or they may contain a mixture of different molecular species.

As organopolysiloxanes which contain at least 3 Si-bonded hydrogen atoms per molecule, it is possible to use in the method of this invention the same organopolysiloxanes which contain at least 3 Si-bonded hydrogen atoms which have been used heretofore in compositions for impregnating organic fibers which contain diorganopolysiloxanes having SiC-bonded organic radicals with aliphatic multiple bonds and which also cross-link by the addition of Si-bonded hydrogen to SiC-bonded organic radicals having aliphatic multiple bonds. The organopolysiloxanes having at least 3 Si-bonded hydrogen atoms per molecule can be linear, branched or cyclic.

The silicon valences in the organopolysiloxanes which contain at least 3 Si-bonded hydrogen atoms per molecule which are not saturated by hydrogen and siloxane oxygen atoms are preferably saturated by methyl, ethyl or phenyl radicals or a mixture of at least two such radicals.

Preferred organopolysiloxanes having at least 3 Si-bonded hydrogen atoms per molecule may be represented by the following formula:

$$(CH_3)_3SiO(SiR_2^2O)_pSi(CH_3)_3,$$

in which $R^2$ is hydrogen or the same or different hydrocarbon radicals such as the methyl, ethyl or phenyl radical and p is an integer having a value of from 10 to 500, with the proviso that only one hydrogen atom is bonded to one Si atom and the ratio of $R_2^2SiO$ units, in which both $R_2$ are hydrocarbon radicals, to $HR^2SiO$ units, in which $R^2$ is a hydrocarbon radical, is 0:1 to 3:1. The $R^2$ radical is preferably methyl when it is not hydrogen.

If desired, however, the 3 Si-bonded hydrogen atoms and SiC-bonded organic radicals can be in one and the same molecule.

The organopolysiloxanes used in the method of this invention, which contain at least 3 Si-bonded hydrogen atoms per molecule, preferably contain at least 0.1 weight percent of Si-bonded hydrogen per molecule.

The organopolysiloxanes which contain at least 3 Si-bonded hydrogen atoms per molecule may contain a single molecular species or it may contain a mixture of different molecular species.

The organopolysiloxanes used in the method of this invention, which contain at least 3 Si-bonded hydrogen atoms per molecule, are preferably used in an amount of from 1 to 10 parts by weight per 100 parts by weight of the crosslinkable diorganopolysiloxanes.

When crosslinking occurs by the condensation of Si-bonded hydrogen and Si-bonded hydroxyl groups, a condensation catalyst is generally used as a crosslinking catalyst. Any catalyst may be used which has been or could have been used heretofore to promote the condensation of Si-bonded hydroxyl groups and Si-bonded hydrogen. Examples of such catalysts are in particular carboxylic acid salts of tin or zinc, wherein the hydrocarbon radicals may be bonded directly to these metals. Examples of such catalysts are di-n-butyltin diacetate, di-n-butyltin dilaurate, di-n-butyltin di-2-ethylhexoate, di-2ethylhexyltin di-2-ethylhexoate and zinc octoates. Other examples of condensation catalysts are alkyl titanates such as butyl titanates, triethanolamine titanate and zirconium compounds.

Although only one type of condensation catalyst need be used, it is possible to use a mixture of at least two different types of condensation catalysts, such as for example, a mixture of di-n-butyltin dilaurate and butyl titanates.

The condensation catalyst is preferably used in an amount of from 0.3 to 6 parts by weight per 10 to 90 parts by weight of crosslinkable diorganopolysiloxane.

When crosslinking is obtained by the addition of Si-bonded hydrogen to SiC-bonded organic radicals containing aliphatic multiple bonds, a catalyst which promotes the addition of Si-bonded hydrogen to aliphatic multiple bonds is used as the crosslinking catalyst. Any catalyst may be used which has been used or could have been used heretofore to promote the addition of Si-bonded hydrogen to SiC-bonded organic radicals containing aliphatic multiple bonds. Examples of such catalysts are finely divided platinum, ruthenium, rhodium, palladium and iridium in which these metals may be carried on a solid support such as silicon dioxide, aluminum oxide or activated carbon. Compounds or complexes of these elements, such as platinum-alcohol complexes, platinum-alcoholate complexes, platinum-ether complexes, platinum-aldehyde complexes, platinum-ketone complexes including the reaction product of $H_2PtCl_6.6H_2O$ and cyclohexanone, platinum-vinylsiloxane complexes and in particular platinum-divinyltetramethyldisiloxane complexes with or without a detectable content of inorganically bonded halogen, bis(γ-picoline)-platinum dichloride, trimethylenepyridine platinum dichloride, dicyclopentadieneplatinum dichloride, dimethyl sulfoxide-ethyleneplatinum (II) dichloride and reaction products of platinum tetrachloride dissolved in 1-octene and sec-butylamine may be used as catalysts. Platinum compounds or platinum complexes are the preferred catalysts for promoting the addition of Si-bonded hydrogen to SiC-bonded organic radicals containing aliphatic multiple bonds.

Only one type of catalyst which promotes the addition of Si-bonded hydrogen to SiC-bonded organic radicals containing aliphatic multiple bonds need be used, however, a mixture of at least two such catalysts may also be employed.

When a platinum compound or platinum complex is used as the catalyst for promoting the addition of Si-bonded hydrogen to SiC-bonded organic radicals containing aliphatic multiple bonds, such a catalyst is preferably used in an amount of from 0.002 to 0.02 parts by weight, calculated as elemental platinum, per 100 parts by weight of organopolysiloxane containing SiC-bonded aliphatic multiple bonds.

In the organo(poly)siloxanes containing 1 or 2 Si-bonded hydrogen atoms per molecule, the silicon valences which are not saturated by hydrogen and siloxane oxygen atoms are preferably saturated by methyl, ethyl or phenyl radicals or a mixture of at least two such radicals. The methyl radical is preferred as the organic radical in the organo(poly)siloxanes containing 1 or 2 Si-bonded hydrogen atoms per molecule.

Preferred examples of organo(poly)siloxanes containing 1 or 2 Si-bonded hydrogen atoms and 2 to 8 silicon atoms per molecule are represented by the following formulas:

$$HSi(CH_3)_2OSi(CH_3)_3 \text{ and}$$

$$HSi(CH_3)_2O[Si(CH_3)_2O]_mSi(CH_3)_2H,$$

in which m is 0 or an integer having a value of from 1 to 6 and more preferably from 1 to 4. These compounds, which contain one Si-bonded hydrogen atom in at least one terminal unit are generally linear diorgano(poly)siloxanes.

One type of organo(poly)siloxane containing 1 or 2 Si-bonded hydrogen atoms and 2 to 8 silicon atoms per molecule, or a mixture containing at least two such organo(poly)siloxanes may be used.

The organo(poly)siloxane containing 1 or 2 Si-bonded hydrogen atoms and 2 to 8 silicon atoms per molecule is preferably used in an amount of from 0.2 to 10 parts by weight per part by weight of organopolysiloxane containing at least 3 Si-bonded hydrogen atoms per molecule.

It is assumed that the Si-bonded hydrogen atoms of the organo(poly)siloxane containing 1 or 2 Si-bonded hydrogen atoms and 2 to 8 silicon atoms per molecule condense with the Si-bonded hydroxyl groups of the crosslinkable diorganopolysiloxane or the Si-bonded hydrogen adds to the SiC-bonded organic radicals having aliphatic multiple bonds of the crosslinkable diorganopolysiloxane.

In addition to the previously mentioned components, other substances can also be used in the method of this invention. When crosslinking occurs by the condensation of Si-bonded hydrogen and Si-bonded hydroxyl groups, other substances which may be present are organopolysiloxanes which have at least two monovalent SiC-bonded organic radicals per molecule which are substituted with basic nitrogen in addition to the diorganosiloxane units in which the two organic radicals are monovalent hydrocarbon radicals. An example of such a substance is the reaction product of a dimethylpolysiloxane containing one Si-bonded hydroxyl group in each terminal unit and having a viscosity of 100 mPa.s at 25° C. and a silane having the formula:

$$H_2N(CH_2)_2NH(CH_2)_3Si(OCH_3)_3,$$

in which the reaction product has an amine number of 3 (number of ml of 1 N HCl required to neutralize 1 g of substance) and a viscosity of 40 mPa.s at 25° C. These amine substituted organopolysiloxanes are described in U.S. Pat. No. 3,849,339 to Nitzsche et al.

Other substances which may be employed are silanes having the following formula or partial hydrolyzates thereof:

$$R^3SiR_a^4X_{3-a},$$

where R3 represents a monovalent SiC-bonded organic radical containing carbon, hydrogen, nitrogen and, optionally, oxygen and also contains at least 2 amine groups; $R^4$ is an alkyl or aryl group; X is an alkoxy or alkoxyalkyleneoxy group containing 1 to 14 carbon atoms per radical and a is 0 or 1, and silanes having the formula or partial hydrolyzates thereof:

$$R_a^5SiX_{4-a},$$

wherein $R^5$ is hydrogen or a monovalent hydrocarbon radical or a halogenated monovalent hydrocarbon radical and X and a are the same as above. These silanes are described, for example, in U.S. Pat. No. 3,962,500 to Smith.

Even when crosslinking takes place by the addition of Si-bonded hydrogen to SiC-bonded organic radicals containing aliphatic multiple bonds, other substances such as agents which inhibit or retard the addition of Si-bonded hydrogen to aliphatic multiple bonds at ambient temperature may be used in the method of this invention. Examples of such inhibiting agents are ethinylcyclohexanol or maleate monoethyl ester.

Another substance which may be employed in the method of this invention is a trimethylsiloxy endblocked diorganopolysiloxane in which one SiC-bonded vinyl group is present in 0.033 to 50 percent of the number of diorganosiloxane units while the other organic radicals in the diorganosiloxane units of this diorganopolysiloxane are free of aliphatic multiple bonds. The viscosity of such a diorganopolysiloxane is preferably at least $10^6$ mPa.s at 25° C. Examples of other substances which may be employed are organosilicon compounds that are suitable as adhesives such as the organosilicon compound obtained by heating for one hour at 200° C. a mixture containing 10 parts by weight of vinyltriacetoxysilane and 13 parts by weight of a silane having the formula:

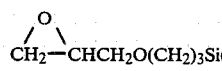

$$CH_2\text{—}CHCH_2O(CH_2)_3Si(OCH_3)_3.$$

If basic substances are also used as additional substances, then an acid such as acetic acid is preferably used at the same time in order to avoid a premature splitting off of Si-bonded hydrogen.

Textile materials may be impregnated with the compositions of this invention in an undiluted form or as solutions in an organic solvent or in the form of aqueous emulsions. If aqueous emulsions are used, these emulsions may also contain thickening agents such as N-vinylpyrrolidone in addition to water as well as dispersing agents.

The compositions used in the method of this invention may be applied to the textile materials by any manner which is generally known and suitable for impregnating textile materials with liquid substances, for example, by immersion, painting, pouring, spraying, rolling on, pressing, doctor or wiper coating and including the use of a Meyer rod or an air brush.

Crosslinking by condensation of Si-bonded hydrogen and Si-bonded hydroxyl groups may proceed at ambient temperature or it can be accelerated by heating, for example, to from 50° C. to 180° C.

Crosslinking by the addition of Si-bonded hydrogen to SiC-bonded organic radicals containing aliphatic multiple bonds is brought about by heating to temperatures of preferably at least 110° C. Temperatures of from 140° C. to 160° C. for from 5 to 80 seconds are preferred. Instead of heating, or in addition to heating, crosslinking can be triggered, for example, by ultraviolet radiation.

All woven or knit textile materials made of organic fibers which have been impregnated or could have been impregnated with organosilicon compounds may be impregnated by the method of this invention. The organic fibers from which the textile materials are produced can be natural or synthetic fibers. Examples of such fibers are fibers made of keratin and, in particular, wool, cotton, rayon, hemp, natural silk, polypropylene, polyethylene, polyester, polyurethane, polyamide, cellulose acetate and mixtures of at least two such fibers. The textile materials may take the form of a fabric web or articles of clothing or parts of articles of clothing.

Textiles made of organic fibers which have been impregnated in accordance with this invention not only have a soft hand, but are also waterproofed or water-repellent. Furthermore, when keratin and wool, and in particular keratin, which have been pretreated with chlorine, rinsed and neutralized is impregnated in accordance with this invention, the resultant textile material is free of shrinkage.

The platinum complex-diluent mixture used in some of the following examples was prepared in accordance with the following procedure, in which all parts in the Examples are by weight unless otherwise specified.

About 20 parts of sodium bicarbonate were added to a mixture containing 10 parts of $H_2PtCl_6.6H_2O$, 20 parts of 1,3-divinyl-1,1,3,3-tetramethyldisiloxane and 50 parts of ethanol. The mixture was heated at reflux for 30 minutes with stirring. It was then allowed to stand for 15 hours and subsequently filtered. The volatile components were distilled off from the filtrate at approximately 16 mbar(abs). The residue was dissolved in a vinyldimethylsiloxy endblocked dimethylpolysiloxane having a viscosity of 1000 mPa.s at 25° C., in such an amount that the solution contained 1 weight percent of platinum, calculated as the elemental platinum.

EXAMPLE 1

A solution containing:

(a) 25.0 parts of a dimethylpolysiloxane having one Si-bonded hydroxyl group in each terminal unit and a viscosity substantially above $10^6$ mPa.s at 25° C., that is, a value of 5400 J as determined by a Brabender Plastograph at 25° C. and at 60 rpm (a Brabender Plastograph is shown, for example, in K. Frank, "Testing Book for Rubber", Stuttgart, 1955, page 25);

(b) 0.75 parts of a trimethylsiloxy endblocked methylhydrogenpolysiloxane having a viscosity of 20 mPa.s at 25° C.;

(c) 3.0 parts of pentamethyldisiloxane;

(d) 1.0 part of the product obtained from the reaction of a dimethylpolysiloxane which has one Si-bonded hydroxyl group in each terminal unit and a viscosity of 100 mPa.s at 25° C. with a silane having the formula:

$$H_2N(CH_2)_2NH(CH_2)_3Si(OCH_3)_3,$$

in which the reaction product has an amine number of 3 (ml of 1 N HCl required to neutralize 1 g of substance) and a viscosity of 40 mPa.s at 25° C.;

(e) 1.0 part of acetic acid; and (f) 1.0 part of di-n-butyltin diacetate in 68.25 parts of toluene, is applied twice with a doctor blade to a fabric consisting of a tightly woven polyamide taffeta (filament weave) at a weight of 60 g/m$^2$. The impregnated fabric is heated to 150° C. for 1 minute after each application. The fabric has a coating weight of 13 g/m$^2$ and a pleasant, soft hand.

The waterproof value of the impregnated fabric corresponds to a 1000 mm water column according to DIN (German Industry Standard) 53 886. This value is unchanged after 5 mild washings at 30° C. in a household washing machine or after treating five times for 20 minutes with perchloroethylene, such as occurs in a chemical cleaning operation.

COMPARISON EXAMPLE $V_1$

The procedure described in Example 1 is repeated except that the pentamethyldisiloxane is omitted.

The impregnated fabric has the same water impermeability properties as the impregnated fabric of Example 1; however, it has a harsh hand.

EXAMPLE 2

A solution containing:

(a) 30.0 parts of a dimethylpolysiloxane which has one Si-bonded hydroxyl group in each terminal unit and a viscosity substantially above $10^6$ mPa.s at 25° C., that is, a value of 4400 J as determined by a Brabender Plastograph at 25° C. and at 60 rpm;

(b) 1.0 part of a trimethylsiloxy endblocked organopolysiloxane containing 25 mol percent of dimethylsiloxane units and 75 mol percent of methylhydrogen siloxane units and a viscosity of 100 mPa.s at 25° C.;

(c) 2.5 parts of 1,3-dihydrogen-1,1,3,3-tetramethyldisiloxane;

(d) 0.5 parts of a silane having the formula:

$$H_2N(CH_2)_2NH(CH_2)_3Si(OCH_3)_3$$

(e) 0.5 parts of 1,3-dimethyl-1,1,3,3-tetramethoxydisiloxane;

(f) 1.0 part of di-n-butyltin diacetate; and (g) 1.0 part acetic acid in 63.5 parts of xylene isomer mixture, is applied with a doctor blade to a fabric consisting of a tightly woven polyester filament weave at a weight of 70 g/m$^2$. The impregnated fabric is heated for 1 minute to 150° C. after the application. The fabric has a coating weight of 11 g/m$^2$ and a pleasant, soft hand.

The waterproof value of the fabric corresponds to a 1000 mm water column according to DIN 53 886. This value was unchanged after 5 mild washings at 30° C. in a household washing machine or after treating 5 times for 20 minutes with perchloroethylene, such as occurs in a chemical cleaning operation.

COMPARISON EXAMPLE $V_2$

The procedure in Example 2 is repeated except that the tetramethyldisiloxane is omitted.

The impregnated fabric has the same water impermeability properties as the impregnated fabric of Example 2, except that it has a harsh hand.

EXAMPLE 3

A solution containing:

(a) 22.0 parts of a dimethylpolysiloxane which contains one Si-bonded hydroxyl group in each terminal unit and a viscosity substantially above $10^6$ mPa.s at 25° C., that is, a value of 3920 J as determined with a Brabender Plastograph at 25° C. and at 60 rpm;

(b) 0.7 parts of a trimethylsiloxy endblocked methylhydrogenpolysiloxane having a viscosity of 20 mPa.s at 25° C.;

(c) 1.5 parts of pentamethyldisiloxane;

(d) 1.0 part of an organopolysiloxane having the formula:

$$HSi(CH_3)_2O[Si(CH_3)_2O]_4Si(CH_3)_2H;$$

(e) 1.0 part of an adhesive obtained from the reaction of a dimethylpolysiloxane containing one Si-bonded hydroxyl group in each terminal unit and a viscosity of 100 mPa.s at 25° C. and a silane of the formula:

$$H_2N(CH_2)_2NH(CH_2)_3Si(OCH_3)_3,$$

in which the reaction product has an amine number of 3 and a viscosity of 40 mPa.s at 25° C.;

(f) 1.0 part of acetic acid; and (g) 1.0 part of di-n-butyltin dilaurate in 71.8 parts of perchloroethylene, is applied twice with a doctor blade to a fabric consisting of a tightly woven polyamide taffeta (filament weave) at a weight of 60 g/m$^2$. The impregnated fabric is heated to 150° C. for 1 minute after each application. The fabric has a coating weight of 14 g/m$^2$ and a pleasant, soft hand.

The waterproof value of the impregnated fabric corresponds to a 1000 mm water column according to DIN 53 886. This value remains unchanged after 5 mild washings at 30° C. in a household washing machine or after being treated 5 times for 20 minutes with perchloroethylene, such as occurs in a chemical cleaning operation.

COMPARISON EXAMPLE $V_3$

The procedure described in Example 3 is repeated, except that the pentamethyldisiloxane and the organopolysiloxane containing one Si-bonded hydrogen atom in each terminal unit are omitted.

The impregnated fabric has the same water impermeability properties as the impregnated fabric of Example 3, except that it has a harsh hand.

EXAMPLE 4

A solution containing:

(a) 18.0 parts of a diorganopolysiloxane containing 99.5 mol percent of dimethylsiloxane units and 0.5 mol percent of vinylmethylsiloxane units and a viscosity substantially above $10^6$ mPa.s at 25° C., that is, a value of 5100 J as determined with a Brabender Plastograph at 25° C. and at 60 rpm;

(b) 9.0 parts of a diorganopolysiloxane containing 99.95 mol percent of dimethylsiloxane units and 0.05 mol percent of vinylmethylsiloxane units and a value of 7160 J as determined with a Brabender Plastograph at 25° C. and at 60 rpm;

(c) 5.0 parts of a vinyldimethylsiloxy endblocked dimethylpolysiloxane having a viscosity of 20,000 mPa.s at 25° C.;

(d) 1.0 part of a trimethylsiloxy endblocked organopolysiloxane consisting of 25 mol percent of dimethylsiloxane units and 75 mol percent of methylhydrogensiloxane units and a viscosity of 100 mPa.s at 25° C.;

(e) 4.0 parts of an organopolysiloxane of the formula:

$$HSi(CH_3)_2O[Si(CH_3)_2O]_4Si(CH_3)_2H;$$

(f) 1.0 part of an organosilicon compound which is obtained by heating a mixture containing 100 g of vinyltriacetoxysilane and 130 g of a silane of the formula:

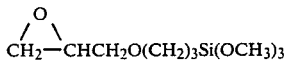

for 1 hour at 200° C.;

(g) 0.2 parts of the platinum complex-diluent mixture prepared above; and (h) 0.1 part ethinylcyclohexanol in 61.7 parts of an alkane mixture having a boiling range of from 135° C. to 180° C. at 1013 mbar (abs.), is applied twice with a doctor blade on a fabric consisting of a tightly woven polyamide taffeta (filament weave) at a weight of 60 g/m$^2$. The impregnated fabric is heated to 150° C. for 45 seconds after each application. The fabric has a coating weight of 13 g/m$^2$ and a pleasant, soft hand.

The waterproof value of the impregnated fabric corresponds to a 1000 mm water column according to DIN 53 886. This value remains unchanged after 5 mild washings at 30° C. in a household washing machine or after treating 5 times for 20 minutes with perchloroethylene, such as occurs in a chemical cleaning operation.

EXAMPLE $V_4$

The procedure described in Example 4 is repeated, except that organopolysiloxane (e) containing one Si-bonded hydrogen atom in each terminal unit is omitted.

The impregnated fabric has the same water impermeability properties as the impregnated fabric of Example 4, except that it has a harsh hand.

EXAMPLE 5

A solution containing:

(a) 15.0 parts of component (a) of Example 4;

(b) 7.5 parts of component (b) of Example 4;

(c) 4.0 parts of component (c) of Example 4;

(d) 1.0 part of a trimethylsiloxy endblocked methylhydrogenpolysiloxane having a viscosity of 20 mPa.s at 25° C;

(e) 1.0 part of an organopolysiloxane having the formula:

$$HSi(CH_3)_2O[Si(CH_3)_2O]_6Si(CH_3)_2H;$$

(f) 1.0 part of the adhesive component (f) of Example 4;

(g) 0.2 parts of the platinum complex-diluent mixture prepared above; and (h) 0.1 part of ethinylcyclohexanol in 70.2 parts of toluene, is applied with a doctor blade to a woven fabric consisting of 50 weight percent cotton and 50 weight percent polyester at a weight of 200 g/m$^2$. The impregnated fabric is then heated to 150° C. for 45 seconds. The fabric has a coating weight of 24 g/m$^2$ and a pleasant, soft hand.

The waterproof value of the impregnated fabric corresponds to a 250 mm water column according to DIN 53 886. This value is still 200 mm after 5 mild washings at 30° C. in a household washing machine or after treating 5 times for 20 minutes with perchloroethylene, such as occurs in a chemical cleaning operation.

COMPARISON EXAMPLE $V_5$

The procedure described in Example 5 is repeated, except that the organopolysiloxane (e) having one Si-bonded hydrogen atom in each terminal unit is omitted.

The impregnated fabric has the same water impermeability properties as the impregnated fabric of Example 5, except that it has a harsh hand.

EXAMPLE 6

An aqueous dispersion is prepared by mixing:

(a) 96.0 parts of a methylol containing aqueous dispersion of a copolymer of ethylene, vinyl acetate and N-methylolacrylamide having a solids content of 45 weight percent (Vinnapas® EN 300, Wacker-Chemie GmbH); with (b) 1.5 parts of the adhesive component (f) of Example 4; and (c) 2.5 parts of a 30 weight percent aqueous solution containing a copolymer of N-vinylpyrrolidone (Collacral® VL, BASF) which is used as a thickening agent; and then applied with a doctor blade to a fabric consisting of a woven polyester at a weight of 154 g/m$^2$. The warp yarn was filament yarn and the weft yarn was staple fiber yarn. The impregnated fabric is dried by heating at 95° C. for 45 seconds after the application.

An aqueous dispersion is then applied using a doctor blade on the pretreated fabric. The dispersion contains the following ingredients:

(a) 50 parts of a vinyldimethylsiloxy endblocked dimethylpolysiloxane having a viscosity of 1000 mPa.s at 25° C.;

(b) 50 parts of a vinyldimethylsiloxy endblocked dimethylpolysiloxane having a viscosity of 20,000 mPa.s at 25° C.;

(c) 5 parts of a trimethylsiloxy endblocked diorganopolysiloxane consisting of 85.7 mol percent of dimethylsiloxane units and 14.3 mol percent of vinylmethylsiloxane units and having a viscosity of 1000 mPa.s at 25° C.;

(d) 3 parts of a trimethylsiloxy endblocked organopolysiloxane containing 50 mol percent of methylhydrogensiloxane units and 50 mol percent of dimethylsiloxane units and a viscosity of 120 mPa.s at 25° C.;

(e) 10 parts of an organopolysiloxane having the formula:

$$HSi(CH_3)_2O[Si(CH_3)_2O]_6Si(CH_3)_2H;$$

(f) 0.2 parts of ethinylcyclohexanol; and (g) 0.5 parts of the platinum complex-diluent mixture prepared above, in which 50 parts correspond to a concentration of 20 weight percent in this emulsion and 9 parts of this emulsion, after the addition of a little aqueous ammonia, were thickened with 1 part of a 6 weight percent dispersion of polyacrylic acid or polymethacrylic acid (Rohagit® SD 15, Rohm GmbH).

The impregnated fabric is dried by heating at 95° C. for 45 seconds. The organopolysiloxane is then crosslinked by heating at 150° C. for 2 minutes. The fabric has a coating weight of 32 g/m$^2$ and a pleasant, soft hand.

The waterproof value of the fabric corresponds to a 400 mm water column according to DIN 53 886.

COMAPRISON EXAMPLE $V_6$

The procedure described in Example 6 is repeated, except that the organopolysiloxane (e) having one Si-bonded hydrogen atom in each terminal unit is omitted.

The impregnated fabric has the same water impermeability properties as the impregnated fabric of Example 6, except that it has a harsh hand.

What is claimed is:

1. A method for impregnating textile materials made from organic fibers which comprises impregnating the textile materials with a composition containing a crosslinkable diorganopolysiloxane, an organopolysiloxane having at least 3 Si-bonded hydrogen atoms per molecule, a crosslinking catalyst, and an organo(poly)siloxane having 1 or 2 Si-bonded hydrogen atoms and from 2 to 8 silicon atoms per molecule in which the composition is free of a filler having a surface area greater than 50 g/m$^2$ in an amount greater than 1 weight percent based on the weight of the organosilicon compounds and thereafter crosslinking the corsslinkable diorganopolysiloxane.

2. The method of claim 1, wherein at least one linear diorgano(poly)siloxane having one Si-bonded hydrogen atom in at least one terminal unit is used as the organo(poly)siloxane having 1 or 2 Si-bonded hydrogen atoms and from 2 to 8 silicon atoms per molecule.

3. The method of claim 1, wherein the organo(poly)-siloxane having 1 or 2 Si-bonded hydrogen atoms and from 2 to 8 silicon atoms per molecule is used in an amount of from 0.2 to 10 parts by weight per part by weight of the organopolysiloxane having at least 3 Si-bonded hydrogen atoms per molecule.

4. The method of claim 2, wherein the organosiloxane having 1 or 2 Si-bonded hydrogen atoms and from 2 to 8 silicon atoms per molecule is used in an amount of from 0.2 to 10 parts by weight per part by weight of the organopolysiloxane having at least 3 Si-bonded hydrogen atoms per molecule.

5. The method of claim 1, wherein the crosslinkable diorganopolysiloxane is a hydroxyl-terminated diorganopolysiloxane.

6. The method of claim 5, wherein the crosslinking catalyst is a carboxylic acid salt of tin or zinc.

7. The method of claim 1, wherein the crosslinkable diorganopolysiloxane contains SiC-bonded organic radicals having aliphatic multiple bonds.

8. The method of claim 7, wherein the crosslinking catalyst is selected from the group consisting of a platinum compound and a platinum complex.

9. The method of claim 3, wherein the organopolysiloxane having at least 3 Si-bonded hydrogen atoms per molecule is present in an amount of from 1 to 10 parts by weight per 100 parts by weight of the diorganopolysiloxane.

* * * * *